US006708530B2

(12) United States Patent
Mitchell

(10) Patent No.: US 6,708,530 B2
(45) Date of Patent: Mar. 23, 2004

(54) SINGLE-LAYER/DOUBLE-LAYER CUSHION CUP BRASSIERE WITH TERRY LOOP STITCH CONSTRUCTION

(75) Inventor: John Mitchell, Asheboro, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 63 days.

(21) Appl. No.: 10/188,292

(22) Filed: Jul. 2, 2002

(65) Prior Publication Data

US 2004/0003629 A1 Jan. 8, 2004

(51) Int. Cl.[7] ..... A41C 3/04
(52) U.S. Cl. ..... 66/176; 66/194
(58) Field of Search ..... 66/169 R, 170, 66/171, 175, 176, 190, 191, 194, 196, 202; 450/93, 92, 90, 55, 56, 57, 30, 11

(56) References Cited

U.S. PATENT DOCUMENTS

| | | | | | |
|---|---|---|---|---|---|
| 2,041,066 | A | * | 5/1936 | Howard | 450/56 |
| 3,021,844 | A | | 2/1962 | Flagg et al. | 128/463 |
| 3,070,870 | A | | 1/1963 | Alexander et al. | 28/74 |
| 3,146,779 | A | | 9/1964 | Flagg | 128/463 |
| 3,202,565 | A | | 8/1965 | Loftin | 161/73 |
| 3,225,768 | A | | 12/1965 | Galitzki et al. | 128/463 |
| 3,392,730 | A | | 7/1968 | Relli | 128/454 |
| 3,425,246 | A | | 2/1969 | Knohl | 66/71 |
| 3,500,665 | A | | 3/1970 | Braxton et al. | 66/176 |
| 3,537,279 | A | | 11/1970 | Epley | 66/176 |
| 3,789,098 | A | | 1/1974 | Cole et al. | 264/103 |
| 4,531,525 | A | | 7/1985 | Richards | 128/489 |
| 4,624,115 | A | | 11/1986 | Safrit et al. | 66/172 |
| 4,767,377 | A | | 8/1988 | Falla | 450/65 |
| 4,945,576 | A | * | 8/1990 | Melton | 2/460 |
| 5,031,424 | A | | 7/1991 | Peleg et al. | 66/176 |
| 5,081,854 | A | | 1/1992 | Lonati | 66/176 |
| 5,479,791 | A | | 1/1996 | Osborne | 66/171 |
| 5,553,468 | A | | 9/1996 | Osborne | 66/171 |
| 5,592,836 | A | | 1/1997 | Schuster et al. | 66/176 |
| 5,850,745 | A | | 12/1998 | Albright | 66/176 |
| 5,946,944 | A | | 9/1999 | Osborne | 66/176 |
| 6,015,331 | A | * | 1/2000 | Ioakim | 450/37 |
| 6,070,438 | A | | 6/2000 | Okuno et al. | 66/172 |
| 6,125,664 | A | | 10/2000 | Browder, Jr. | 66/176 |
| 6,192,717 | B1 | * | 2/2001 | Rabinowicz | 66/177 |
| 6,196,030 | B1 | | 3/2001 | Stoll et al. | 66/178 |
| 6,263,707 | B1 | | 7/2001 | Miller et al. | 66/171 |
| 6,272,888 | B1 | * | 8/2001 | Fujita et al. | 66/172 E |
| 6,406,353 | B1 | * | 6/2002 | Harper | 450/57 |

FOREIGN PATENT DOCUMENTS

| | | |
|---|---|---|
| DE | 2076634 | 12/1981 |
| JP | 09049104 | 2/1997 |
| JP | 9105002 | 4/1997 |
| JP | 2001073203 | 3/2001 |

* cited by examiner

*Primary Examiner*—Danny Worrell
(74) *Attorney, Agent, or Firm*—Ohlandt, Greeley, Ruggiero & Perle, L.L.P.

(57) ABSTRACT

A brassiere having a terry loop stitch construction knitted into desired portions of the brassiere, preferably within at least the breast cups of the brassiere, is provided. The terry loop may be a true sinker produced terry loop or mock terry loop. The brassiere may be a single-layer brassiere or a double-layer brassiere. A blank for manufacturing the brassiere and method of manufacturing the brassiere is also provided.

31 Claims, 2 Drawing Sheets

SINGLE-LAYER/DOUBLE-LAYER CUSHION CUP BRASSIERE WITH TERRY LOOP STITCH CONSTRUCTION

BACKGROUND OF THE INVENTION

1. Field of the Invention

The present invention relates to a brassiere having a terry loop stitch construction knitted into a fabric, a blank for making the brassiere, and methods for making the brassiere and the blank made on a circular knitting machine. More particularly, the present invention relates to a single-layer or double-layer circular knit brassiere formed from a blank of a circular knitting machine in which the brassiere includes a terry loop stitch construction knitted into one or more selected portions of the brassiere.

2. Description of the Prior Art

The use of generally cylindrical blanks in the manufacture of brassieres is known. For example, U.S. Pat. No. 6,125,664, to Browder, Jr., entitled BRASSIERE, BRASSIERE BLANK AND METHODS OF MAKING SAME describes the use of a cylindrical blank to form one double layer brassiere. The brassiere has an outer fabric and an inner fabric. The yarn and knit stitches for the inner fabric are provided to provide comfort to the wearer. The blank is formed in a generally cylindrical shape with a bottom welt band seamlessly joined to a bottom edge of an upper torso part formed in the outer fabric and to a bottom edge of an upper torso part formed in the inner fabric. Front and rear strap portions are formed in the upper torso parts.

However, a need exists for an improved brassiere having fabric contacting the wearer's body that provides moisture or perspiration wicking and other comfort features.

SUMMARY OF THE INVENTION

It is an object of the present invention to provide a seamless circular knit brassiere with a terry loop stitch construction knitted into the brassiere.

It is another object of the present invention to provide a seamless double layer circular knit brassiere formed from a blank having both an inner and outer layer of fabric, a band seamlessly joined to a bottom edge of each layer, and a terry loop stitch construction knitted into a selected portion of at least one of the layers.

It is yet another object of the present invention to provide a seamless circular knit brassiere formed from a substantially different fabric construction and yarn combination that utilizes a true terry loop or a mock terry loop stitch construction knitted into at least the breast cup areas of the brassiere.

It is a further object of the present invention to provide a seamless circular knit brassiere having an inner and outer layer formed from a substantially different fabric construction and yarn combination, that utilizes a true terry loop or a mock terry loop stitch construction knitted into at selected portions of one of the layers of the brassiere.

It is still a further object of the present invention to provide a brassiere having substantially functional comfort and moisture wickability properties against the body of the wearer by knitting a hydrophylic yarn in the terry loop stitch construction of the brassiere.

It is yet a further object of the present invention to provide a single blank for manufacturing a single-layer or a double-layer brassiere having a terry loop stitch construction knitted into a selected area of the brassiere.

It is still yet a further object of the present invention to provide a method of making a seamless circular knit brassiere and blank, knitting a mock terry or true terry stitch construction in at least the breast cup areas of the blank to function as a comfort cushion against the wearer's body when the brassiere is worn.

These and other objects, and advantages of the present invention will be achieved by a brassiere according to the present invention having an upper torso part seamlessly joined to a band, where a terry loop stitch construction is knitted into a selected portion of the upper torso part. In an alternative embodiment, the upper torso part has an outer fabric and an inner fabric, with each fabric connected to a band, and with a terry loop stitch construction knitted into at least a selected portion of the inner or outer fabric.

BRIEF DESCRIPTION OF THE DRAWINGS

The above and other objects, advantages and benefits of the present invention will be understood by reference to the detailed description provided below and the accompanying drawings.

DESCRIPTION OF THE PREFERRED EMBODIMENTS

Figure 1:
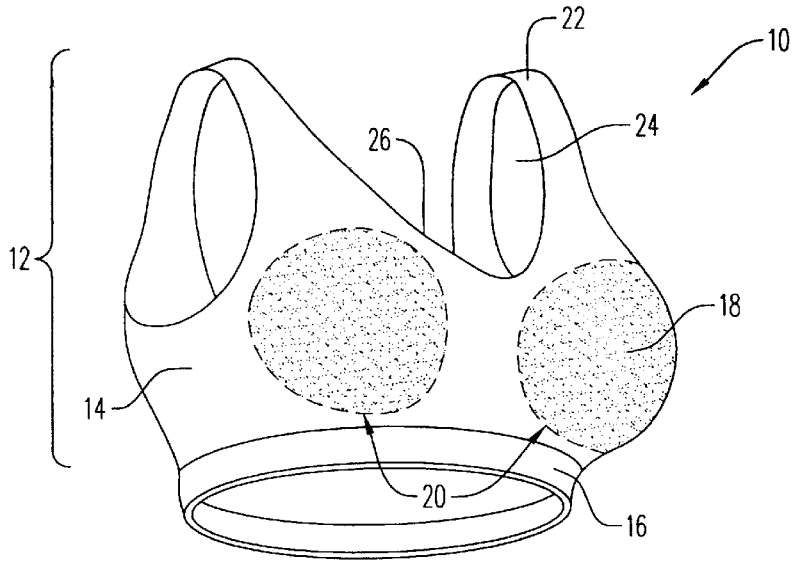
FIG. 1 is a perspective view of a single-layer brassiere according to the present invention.
Figure 2:
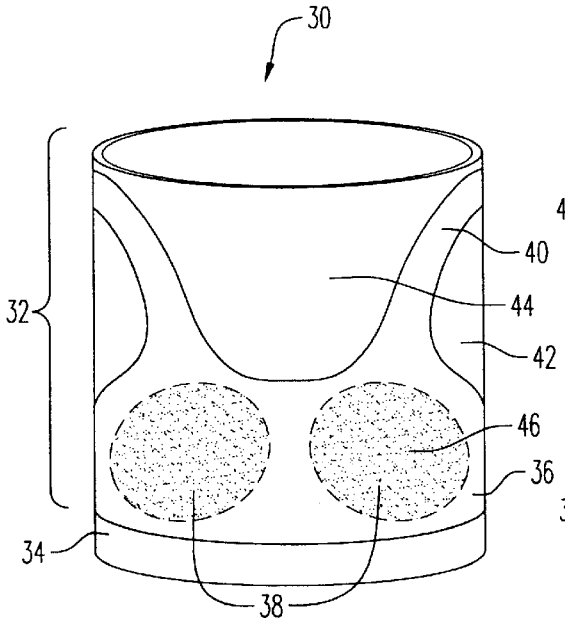
FIG. 2 is front view of a generally cylindrical blank according to the present invention used in the manufacture of the brassiere of FIG. 1.
Figure 3:
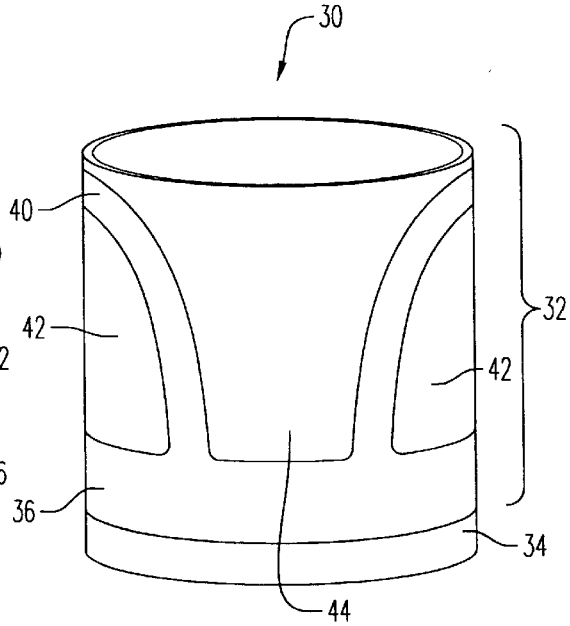
FIG. 3 is rear view of a generally cylindrical blank according to FIG. 2.

Referring to the drawings, and in particular to FIGS. 1–3, there is provided a brassiere according to the present invention generally represented by numeral 10. Brassiere 10 includes an upper torso part 12 formed of a single fabric or fabric layer 14 and a band 16. Brassiere 10 is a single layer brassiere. Single layer 14 includes a terry loop 18 stitch construction knitted into the single layer.

Upper torso part 12 is integrally joined to band 16 in a seamless manner. Band 16 is preferably formed as a turned welt band or as an anchoring chest band. Upper torso part 12 may include breast cups or areas 20 and one or more straps 22. In another embodiment of the invention, the upper torso part 12 may be formed without straps, or with one or more straps 22 attached to upper torso part 12 after the upper torso part is formed.

Single fabric 14 includes material suitable for an inner layer of brassiere 10 and is preferably formed with yarns selected for softness, comfort and wicking properties. Single fabric 14 include yarns with one or any combination of stitches chosen from a group including plain knit, miss, float, and/or tuck, to provide body comfort and support to the wearer. Single fabric 14 is made of either textured nylon having a relatively high number of fine denier filaments or a microfiber having about 20 to about 120 denier or spun yarn, such as cotton, in the size range of about 30/1's to about 70/1's cotton count. Such yarn provides softness, comfort and desired moisture wicking properties.

Additionally, single fabric 14 can be formed using an elastomeric stretch yarn such as spandex in combination with said nylon or cotton non-stretch yarns.

Single fabric 14 includes a terry loop 18 stitch construction knitted within at least a selected area of the single fabric. Terry loop 18 stitch construction preferably has a true terry loop or mock terry loop stitch construction. Terry loop 18 stitch construction may include a combination of a mock terry loop and true terry loop. Terry loop 18 may be knitted into specific portions of the single fabric or layer 14. For example, FIG. 1 shows the terry loop 18 stitch construction knitted in the breast cup areas 20 of single fabric 14. Also, terry loop 18 may be knitted into at least the front portion of straps 22, or the terry loop may be knitted any portion of the single fabric 14, including the entire single fabric.

Terry loop 18 stitch construction may itself contact the body of the wearer. The brassiere 10 may provide substantially functional comfort and moisture wickability properties against the body of the wearer in contact with terry loop 18. Terry loop 18 may have a hydrophylic yarn of any suitable material. Such yarns include, but are not limited to, cotton, textured microdenier nylon, or a synthetic continuous multifilament textured nylon having substantial wickable moisture properties.

Band 16 may include materials that are denser than the single layer 14. Band 16 may also be formed, for example, as a turned welt band and/or as an anchoring chest band by adding in, during the circular knitting process, additional heavier denier bare spandex elastomeric yarn, or less preferably, a nylon covered spandex yarn thereby causing a greater fabric density in band 16, than the fabric and yarn density used to form the single layer 14.

Brassiere 10 is formed with a conventional circular knitting machine having electronic programable design capability. The program provides one or more stitch types to produce a blank 30 having an upper torso part 32 and a bottom band 34 as shown in FIGS. 2 and 3. Blank 30 is formed by a circular weft knitting machine that preferably has a computerized electronic needle and yarn feed selection system, such as circular knit machine Model No. SM8-8, or SM8-TOP as manufactured by Santoni® of Brescia, Italy. Blank 30 is a generally cylindrical tube having portions that, upon manufacture of brassiere 10, correspond to portions of the brassiere.

Blank 30 is formed by a series of circular knitting courses. The courses for both the upper torso part 32 and the bottom band 34 preferably involve a course program that has plain knit or knit and miss-stitch or float stitch construction combinations. In this construction, loops in certain courses are held without additional yarns being taken and then knit into subsequent courses, thereby gathering the courses together and providing the characteristics of band 34.

Upper torso part 32 has a single fabric or fabric layer 36 which may be formed mostly with simple knit constructions, such as plain, tuck, miss, float, or any combinations thereof. Upper torso part 32 may suitably be used to provide special features at various locations of blank 30, such as support for breast areas 38. Band 34 is seamlessly joined to the upper torso part 32. Band 34 is preferably an elastomeric yarn or material, and more preferably, is made of a combination of nylon covered spandex and nylon, with additional supplemental heavier denier spandex threads being added in at least 25 percent of the knitted courses in the band construction of area 34.

Upper torso part 32 is then patterned to define straps 40 and breast cups 38. The patterning also defines outer side removable areas 42 that when removed form arm holes, and front and rear removable areas 44 that when removed form the neckline. A terry loop 46 stitch construction is knitted to upper torso part 32. Terry loop 46 may be integrally stitched to any desired portion of the upper torso part 32. Terry loop 46 stitch construction is knitted into breast cup areas 38 of blank 30 as shown in FIG. 2. Brassiere 10 may then be formed by removing side removable areas 42 to form the arm holes and removing front and rear removable areas 44 to form the neckline.

The entire brassiere 10 is made from a continuous integral cylindrical blank 30 that is formed on a high speed circular knitting machine known in the art. The use of a single fabric 36 with a terry loop 46 stitch construction knitted into at least the breast cup areas 38 as shown in FIG. 2, or continuing in the strap areas, or throughout the entire single fabric, have certain features that provide comfort and wicking to the wearer of brassiere 10.

Brassiere 10 may be a seamless circular knit brassiere formed from a blank 30 in which two straps 22, arm holes 24 and a neckline 26 are defined by patterning and with the additional feature of knitting a mock terry or true terry 18 stitch construction in at least the breast cup portions 20, functioning as a moisture removing and comfort cushion against the wearer's body. A band 16 is seamlessly joined to upper torso part 12 of brassiere 10.

Figure 4:
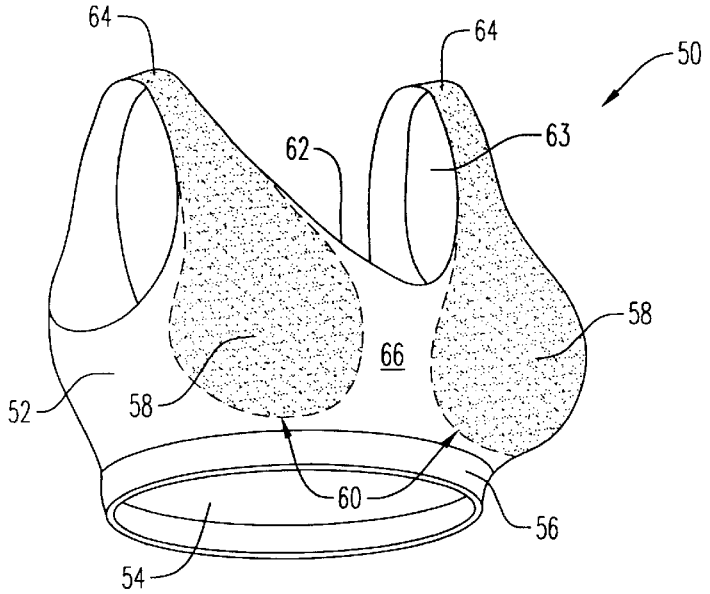
FIG. 4 is a perspective view of a double-layer brassiere according to the present invention.
Figure 5:
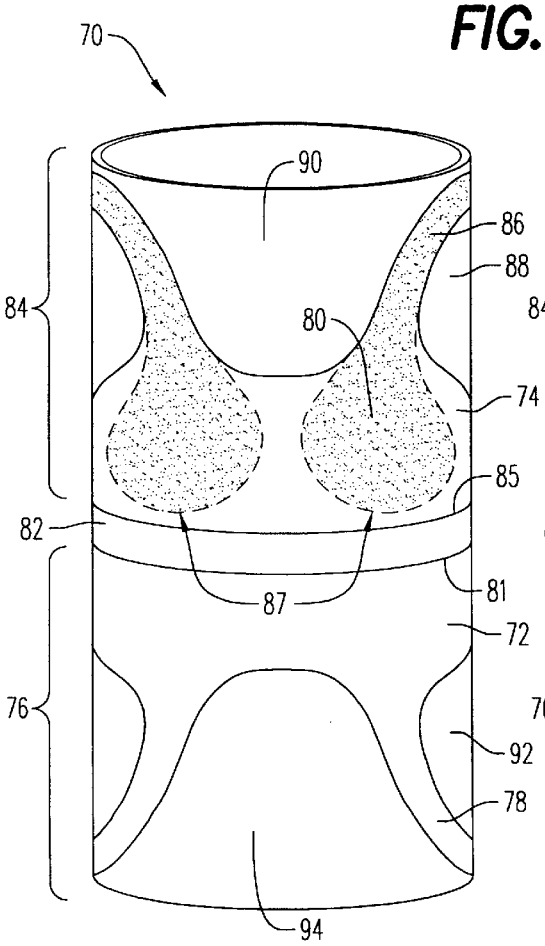
FIG. 5 is a front perspective view of a generally cylindrical blank according to the present invention for use in the manufacture of the brassiere of FIG. 4.
Figure 6:
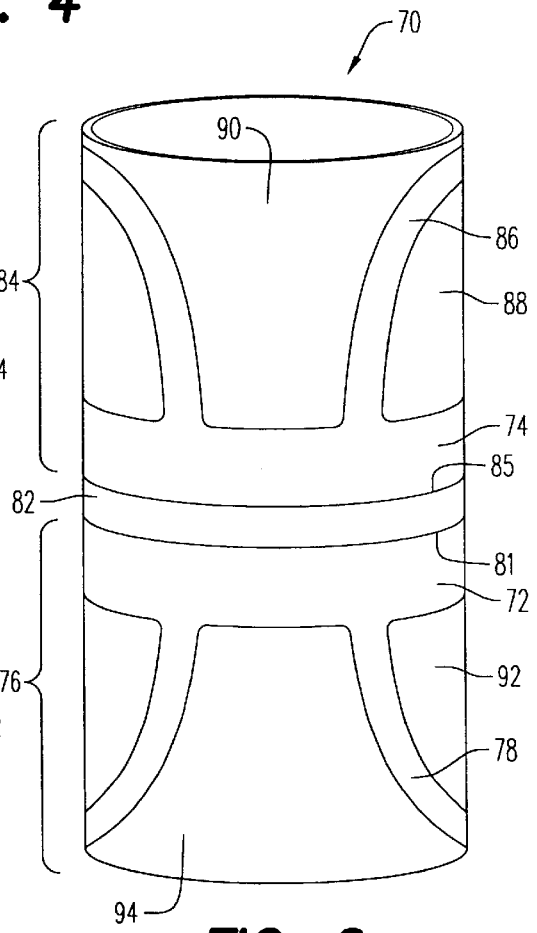
FIG. 6 is rear view of a generally cylindrical blank according to FIG. 5.

With reference to FIGS. 4 to 6, there is provided a second embodiment of the present brassiere 50. Brassiere 50 has a multi or double-layer construction. Brassiere 50 may have an outer fabric or outer layer 52, an inner fabric or inner layer 54, and a band 56 seamlessly joined to each fabric. Band 56 may be formed as a welt or a turn line. Preferably, band 56 is a turned welt having additional supplemental heavier denier spandex added into at least 25 percent of the knitted courses that make up the band. Brassiere 50 has a terry loop 58 stitch construction knitted into selected areas of outer fabric 52 or inner fabric 54.

Outer fabric 52 includes material suitable for an outer layer of brassiere 50. Outer fabric 52 is preferably made of synthetic continuous multifilament flat or textured polymer or spun yarn. Outer fabric 52 preferably also has an elastomeric yarn, such as bare spandex or spandex that is covered with a textured multifilament nylon yarn. The combination of yarns forms a fabric that may contain a spun yarn such as cotton in the range about 30/1's to about 70/1's count or synthetic continuous multifilament flat or textured yarn such as nylon from a range between about 10 denier to about 200 denier, and preferably from about 60 denier to about 120 denier, and a spandex yarn, from a range about 10 denier to about 140 denier, preferably about 15 denier to about 70 denier either bare or may be covered with a suitable synthetic continuous multifilament textured yarn such as nylon.

Outer fabric 52 is formed on a circular knitting machine using one or any combination of knit stitches. Such stitches may include, but are not limited to, plain, tuck, knit, miss or float stitches. Outer fabric 52 may have a plain appearance or, optionally, may have unique aesthetic and recognizable knitted-in characteristics including, but not limited to, a Jacquard pattern design, geometric, stylized logo, abstract, or other designs or patterns such as florals.

Inner fabric 54 may be of the same fabric construction as the single fabric material of the first embodiment. Inner fabric 54 may also include patterning (not shown) that outlines the shape of brassiere 50. The patterning defines parts of the brassiere 50 to be cut and formed, such as the breast cups 60, neckline 62, arm holes 63 and/or straps 64.

A central gore area 66 between breast cups 60, the area under the cups, and the lower area encircling the cups, can also be knitted with discretely placed engineered shorter stretch zones in order to give added support and shaping, as well as comfort, to the wearer of brassiere 50.

Brassiere 50 includes terry loop 58 stitch construction knitted into the breast cup areas 60 and, if so desired, the front portions of the straps 64 of the inner fabric 54. Terry loop 58 stitch construction may be a true terry loop produced using sinkers, or a mock terry loop. Terry loop 58 stitch construction may be knitted on the wearer side of inner fabric 54 of brassiere 50. In other embodiments of the present invention, terry loop 58 stitch construction may be knitted into any selected portion of brassiere 50, such as breast cup areas 60, throughout straps 64, or throughout brassiere 50.

Terry loop 58 stitch construction may also be formed on a specific side of inner fabric 54 or outer fabric 52. For example, in other embodiments of the invention, terry loop 58 stitch construction may be placed between inner fabric 54 and outer fabric 52 by knitting terry loop 58 to the outer facing portion of inner fabric 54, or terry loop 58 may be knitted to the wearer facing portion of outer fabric 52. Terry loop 58 stitch construction may also be provided on the outer side of outer fabric 52. Terry loop 58 is knitted and held in position by inner fabric 54 or outer fabric 52, and terry loop 58 stitch construction will project from both sides of the layer knitted thereto. However, the bulk of terry loop 58 stitch construction will predominately project from only one side of the layer 52, 54 knitted thereto, and that side can be chosen based on the design of brassiere 50.

In another embodiment of the invention, the terry loop 58 stitch construction may be knitted into inner fabric 54 and a second terry loop stitch construction can be knitted into outer fabric 52 of brassiere 50.

Referring to FIGS. 4 and 5, brassiere 50 may be formed from a blank 70. Blank 70 is formed by a high speed circular knitting machine and is a generally cylindrical tube having portions that, upon manufacture of brassiere 50, correspond to portions of the brassiere.

Blank 70 has an outer fabric 72, an inner fabric 74, a band 82, and a terry loop 80 stitch construction knitted into at least one of the fabrics. Outer fabric 72 has an upper torso part 76, strap portions 78, and a lower edge 81 that is seamlessly joined to bottom band 82. Inner fabric 74 has an upper torso part 84 and inner straps 86. Terry loop 80 stitch construction is knitted into the breast cup areas 87 and the front portions of straps 86. In other embodiments of the present invention, terry loop 80 stitch construction may be knitted into selected areas of inner fabric 74 such as only the breast cup areas 87 or the entire inner fabric. In further embodiments of the present invention, terry loop 80 stitch construction may be provided in selected areas of the outer fabric upper torso part 76, such as breast cup areas, strap areas 78 of the entire outer fabric 72. Terry loop 80 stitch construction may also be knitted into each fabric 72, 74.

Blank 70 may be formed by a series of circular knitting courses. The courses for band 82 may include a course program that has predominately plain knit stitches, or, alternately may use stitch combinations of a plain knit and miss-stitch or float stitch construction. In this construction, loops on certain needles in certain courses are held without additional yarns being taken on those certain needles and then knit into subsequent courses, thereby gathering the courses together and providing the appearance and stretch characteristics of bottom band 82.

Upper torso parts 76 and 84 are formed mostly with simple knit constructions, such as plain, tuck, miss, float, or any combinations thereof. Band 82 knit stitches may also suitably be used to provide special features at various locations of blank 80, such as support for breast cup areas.

To manufacture brassiere 50, blank 70 is formed on a circular knitting machine. Blank 70 is formed to include an inner fabric upper torso part 76 seamlessly joined to band 82, and a outer fabric upper torso part 84 seamlessly joined to the same band 82. Terry loop 80 stitch construction is knitted into breast cup areas 87 of inner fabric upper torso part 84.

Inner fabric upper torso part 84 may then be patterned to define side removable areas 88 that when removed define armholes, and front and rear removable sections 90 that when removed define the neckline. Outer fabric upper torso part 76 is also patterned to define side removable areas 92 that define arm holes, and front and rear removable areas 94 that define the neckline.

After patterning the outer fabric upper torso part 76 is drawn over the inner fabric upper torso part 84. Torso parts 76, 84 are then joined, for example by tacking. Side removable areas 88, 92 are cut from the torso parts 76, 84 to form arm holes. Front and rear removable areas 90 and 94 are then removed to form the neckline. The method provides a double layer brassiere 50 formed from a blank 70.

The present invention having been thus described with particular reference to the preferred forms thereof, it will be obvious that various changes and modifications may be made therein without departing from the spirit and scope of the present invention as defined in the appended claims.

What is claimed is:

1. A brassiere formed from a cylindrical shaped blank comprising:

an upper torso part comprising a fabric having a lower edge that is seamlessly joined to a bottom band; and a terry loop stitch construction integrally knitted into one or more selected areas of said fabric of the brassiere.

2. The brassiere according to claim 1, wherein said terry loop stitch construction comprises a true sinker produced terry loop or a mock terry loop.

3. The brassiere according to claim 1, wherein said upper torso part has a pair of breast cups, and wherein said terry loop stitch construction is knitted through at least said pair of breast cups.

4. The brassiere according to claim 1, wherein said upper torso part has a pair of strap portions, and wherein said terry loop stitch construction is knitted through said pair of strap portions.

5. The brassiere according to claim 1, wherein said terry loop stitch construction has a hydrophylic yarn selected from the group consisting of cotton, textured microdenier nylon, and synthetic continuous multifilament textured nylon.

6. The brassiere according to claim 1, further comprising a second upper torso part comprising an outer fabric having a lower edge seamlessly joined from said bottom band.

7. A double layer brassiere formed from a cylindrical shaped blank comprising:

an upper torso part comprising an inner fabric and an outer fabric, each fabric having a lower edge that is seamlessly joined to a bottom welt band;

a terry loop stitch construction integrally knitted into at least one of said fabrics of the brassiere.

8. The brassiere according to claim 7, wherein said terry loop stitch construction comprises a true sinker produced terry loop or a mock terry loop.

9. The brassiere according to claim 7, wherein said upper torso part has a pair of breast cups, and wherein said terry loop stitch construction is knitted through at least said inner fabric of said breast cups.

10. The brassiere according to claim 7, wherein said upper torso part has a pair of breast cups, and wherein said terry loop stitch construction is knitted through at least said outer fabric of said breast cups.

11. The brassiere according to claim 7, wherein said terry loop stitch construction is formed between said fabrics.

12. The brassiere according to claim 7, wherein said upper torso part has strap portions, and wherein said terry loop stitch construction is knitted through at least said inner fabric of said strap portions.

13. The brassiere according to claim 7, wherein said terry loop stitch construction has a hydrophilic moisture wickable yarn selected from the group consisting of cotton, textured microdenier nylon, and synthetic continuous multifilament textured nylon.

14. The brassiere according to claim 7, wherein said inner layer fabric and outer layer fabric differ in fabric construction and/or yarn construction.

15. A blank for manufacturing a brassiere, said blank comprising:

an upper torso part comprising a fabric having a bottom edge seamlessly joined to a band; and a terry loop stitch construction knitted into at least a selected portion of said upper torso part.

16. The blank according to claim 15, wherein said upper torso part further comprises a pair of breast cups, and wherein said terry loop stitch construction is knitted into at least said pair of breast cups.

17. The blank according to claim 15, wherein said terry loop stitch construction comprises a true sinker produced terry loop or a mock terry loop.

18. The blank according to claim 15, wherein said terry loop stitch construction has a hydrophilic moisture wickable yarn selected from the group consisting of cotton, textured microdenier nylon, and synthetic continuous multifilament textured nylon.

19. The blank according to claim 15, wherein said upper torso part further comprises an outer fabric having a bottom edge seamlessly joined to said band and covering said inner fabric.

20. The blank according to claim 19, wherein the selected portion is said outer fabric.

21. The blank according to claim 19, wherein the selected portion is said fabric.

22. A method of making a generally cylindrical seamless circular knit blank for manufacturing a brassiere, the method comprising:

forming a generally cylindrical band;

forming a generally cylindrical upper torso part having a bottom edge seamlessly joined to the torso anchoring chest band;

knitting a terry loop stitch construction into a selected portion of the upper torso part.

23. A method according to claim 22, wherein the terry loop stitch construction comprises a true sinker produced terry loop or a mock terry loop.

24. The method according to claim 22, wherein the upper torso part has a pair of breast cups, and wherein the terry loop stitch construction is knitted through at least the pair of breast cups.

25. The method according to claim 22, wherein the upper torso part has a pair of strap portions, and wherein the terry loop stitch construction is knitted through the pair of straps.

26. The method according to claim 22, wherein said terry loop stitch construction has a hydrophylic moisture wickable yarn selected from the group consisting of cotton, textured microdenier nylon, and synthetic continuous multifilament textured nylon.

27. The method according to claim 22, further comprising forming an outer upper torso part seamlessly joined to the chest anchoring band and the upper torso part.

28. A method of making a generally cylindrical seamless circular knit blank for manufacturing a double layer brassiere, the method comprising:

forming a generally cylindrical band;

forming a inner generally cylindrical upper torso part having a bottom edge seamlessly joined to the chest anchoring band;

forming an outer generally cylindrical upper torso part having a bottom edge seamlessly joined to the chest anchoring band;

knitting a terry loop stitch construction into at least a selected portion of the inner or outer upper torso part.

29. The method according to claim 28, wherein the selected portion is the inner part.

30. The method according to claim 28, wherein the selected portion is the outer part.

31. The method according to claim 28, wherein the terry loop comprises a true sinker produced terry loop or a mock terry loop.

* * * * *